United States Patent [19]

Buehl et al.

[11] 4,354,823

[45] Oct. 19, 1982

[54] NON-AIR COOLED RADIANT BURNER

[75] Inventors: Arnold L. Buehl, Solon; Werner H. Zwipf, Parma, both of Ohio

[73] Assignee: Slyman Manufacturing Corporation, Cleveland, Ohio

[21] Appl. No.: 226,188

[22] Filed: Jan. 19, 1981

[51] Int. Cl.[3] ..... F23D 13/12

[52] U.S. Cl. ..... 431/328; 126/92 AC; 239/145

[58] Field of Search ..... 431/328, 329, 113, 111, 431/7, 343; 126/92 AC, 92 C; 239/145

[56] References Cited

U.S. PATENT DOCUMENTS 3,785,763 1/1974 Bratko ..... 431/328

4,255,123 3/1981 Bishilany et al. ..... 431/328

FOREIGN PATENT DOCUMENTS 760796 11/1956 United Kingdom ..... 431/328

*Primary Examiner*—Samuel Scott

*Assistant Examiner*—Randall L. Green

*Attorney, Agent, or Firm*—Pearne, Gordon, Sessions, McCoy & Granger

[57] ABSTRACT

A single-wall sheet metal box functioning as a gas plenum has an open face closed by a porous matrix of refractory fibers bonded together to form a rigid, boardlike heating element. A combustible gas mixture is fed into the box, forced through the porous heating element, and burned at the outer face thereof to provide a continuous infrared radiant surface. The outer surface of the sheet metal box is completely covered by a blanket of flexible insulation material having an edge portion stuffed between the periphery of the heating element and an adjacent flangelike edge of the box. A first type of snap-on clip maintains the heating element in position, while a second type of snap-on clip retains the stuffed edge of the insulation blanket between the heating element periphery and the adjacent edge of the box.

7 Claims, 4 Drawing Figures

NON-AIR COOLED RADIANT BURNER

BACKGROUND OF THE INVENTION

This invention relates in general to gas-fired radiant burners of the infrared type, and in particular to a radiant burner having a heating element constituted by a boardlike fiber refractory material, commonly referred to as a matrix, that is porous to a combustible gas mixture forced through it from one side for incandescent burning at the other side. A supplier of a suitable refractory material of the subject type is Johns-Manville Corporation of Denver, Co., U.S.A. marketing such material under the trade names "Cera Form" and "Fiberchrome."

U.S. Pat. No. 3,785,763, assigned to the assignee of the present invention, illustrates an early design for a burner of the subject type wherein the open end of a sheet metal box is closed by the boardlike refractory material constituting the heating element or matrix. A combustible gas mixture fed into the box is exhausted through the porous matrix and burned at its exposed outside surface.

In operating this type of burner, it was found that high temperature gas by-products generated by the burning at the matrix surface flowed from around the edge of the matrix against the adjacent portions of the sheet metal box. Uneven heating of such adjacent portions caused severe thermal expansion and contraction of burner elements, resulting in mechanical failure of the sheet metal box or the heating element, or both. This thermal expansion and contraction problem became particularly acute where a burner of the subject type was faced downwardly to, for example, dry a textile fabric web traveling beneath it. Gas by-products would flow upwardly by convection and envelop the sheet metal box, heating portions of it to very high differential temperatures and creating severe thermal stresses in the burner.

A solution to such a problem is proposed by U.S. Pat. No. 4,035,132, which uses a stream of non-combustible cooling air about the periphery of the matrix to shield portions of the sheet metal box from the combusted gas by-products. A burner of the type illustrated by this patent is more complex and costly than a non-air cooled burner of the type illustrated by the heretofore discussed U.S. Pat. No. 3,785,763. It requires a plenum for the air and a plenum for the combustion mixture.

The object of the present invention is to provide a non-air cooled burner that operates satisfactorily in spite of the thermal stress problems noted above.

SUMMARY OF THE INVENTION

In accordance with the present invention, a gas-permeable matrix of refractory fiber material having a generally equal degree of porosity throughout is provided. The matrix has an inner face, an outer face, and a gas nonpermeable peripheral edge separating the faces. A plenum is sealed against the periphery of the inner face of the matrix to supply a pressurized combustible gas thereto for burning at the outer face of the gas-permeable porous matrix. A flexible blanket of insulation material is wrapped around the outside of the plenum to insulate it from high temperature gas by-products generated by the burning, an edge portion of the insulation blanket being biased against the edge of the matrix. A plurality of clips are positioned at spaced intervals about the matrix edge and engage the edge portion of the blanket to maintain it in its biased position against the matrix edge, the clips being supported solely by the plenum means.

Preferably, the plenum is constituted by a sheet metal boxlike structure having an open end closed by a flat, rectangular piece of matrix, with the insulation retaining clips being snapped on the edge of the sheet metal box at its matrix end with the edge portion of the insulation blanket covering the clips to protect them from the high temperature gas by-products.

BRIEF DESCRIPTION OF THE DRAWINGS

The invention will be further understood from the description in the specification and disclosure of the drawing, in which.

DETAILED DESCRIPTION OF THE PREFERRED EMBODIMENT

Figure 1:
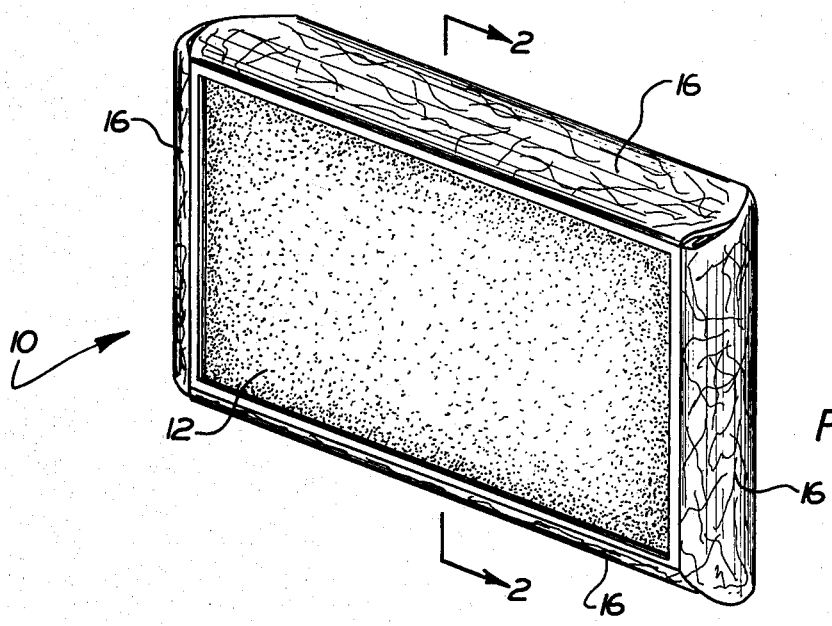
FIG. 1 is a perspective view of a fully insulated, non-air cooled radiant burner in accordance with the present invention.

In accordance with the present invention, and with particular reference to FIG. 1, there is illustrated a non-air cooled, fully insulated, gas-fired radiant burner 10 having a front or outer face 12 constituting a continuous infrared, heat-generating surface. The burner 10 is of a generally rectangular, cubical configuration having four sidewalls and a back wall completely covered by a flexible insulation blanket 16 formed from a fibrous insulating material such as Kaowool manufactured by the Babcock & Wilcox Company, of Augusta, Ga., U.S.A. The forward edge portion 17 (see FIGS. 2, 3, 4) of the blanket 16 adjacent the perimeter of the front face 12 is anchored thereabout in a manner to be subsequently illustrated.

Figure 2:
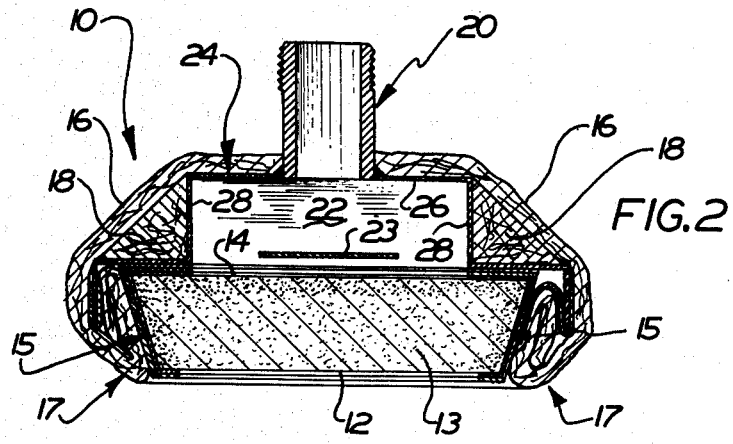
FIG. 2 is a cross-sectional view of the burner of FIG. 1 taken through line 2—2.

With particular reference to FIG. 2, the burner of the present invention is seen to include a conventional combustion gas inlet pipe 20 which supplies a gas mixture plenum area 22. The plenum area 22 is defined by a plenum means in the preferred form of an open-ended, stainless steel sheet metal box 24 having a back wall 26 and four sidewalls 28. The open end of the sheet metal box is closed by a porous matrix of suitable refractory fibers bonded together to form a rigid, boardlike heating element or matrix 13. For example, the matrix can be Cera Form board manufactured by the Johns-Manville Company, of Denver, Colo., U.S.A. Such boards are manufactured from refractory fibers and a multicomponent binder system. The composition of a Cera Form type 130 board is approximately 36% alumina, 54% silica, and 3.5% chromic oxide. The specified density is 13.5 pounds per cubic foot and the specified thermal conductivity is from 0.28 BTU/in., hr., sq. ft. at 400° F. (204° C.) to 1.98 at 2000° F. (1093° C.). A typical matrix board of this type is from about 1.0 inch to about 1.5 or 2.0 inches (2.54 cm–5.0 cm) thick.

The heating element or matrix 13 provides the outer infrared irradiating face 12 and an inner face 14. In the known manner, a combustible gas mixture is fed into the plenum area 22, diffused therein by a conventional baffle 23, and pressurized, wherein the gas flows into the inner face 14 through the porous matrix 13 and out of the outer face 12, wherein it is ignited for burning at the outer face 12. A peripheral edge 15 of the matrix 13 is sealed in a known manner to make it non-permeable to the combustion gas mixture flowing through the matrix 13.

FIG. 2 illustrates the orientation of the burner in a downwardly facing position, wherein high-temperature gas by-products typically (1600° F., 871° C.) generated by burning at the face 12 will flow by convection around and upward about the burner 10. To insulate the sheet metal box 24 and associated burner elements from such high temperature gas by-products, the insulation blanket 16 preferably completely covers the outside of the exposed surfaces of the sheet metal box 24, as illustrated, with a forward edge portion 17 of the blanket being stuffed into and completely filling a channel between a forward flange 30 (see FIGS. 3,4) of the sheet metal box 24 and the peripheral edge 15 of the matrix 13. The flexible insulation material adjacent the peripheral edge 15 of the matrix is preferably biased toward such edge 15 to preclude the entry of the high-temperature gases into the space between the edge of the matrix 15 and the forward edge 30 of the sheet metal box 24.

Figure 3:
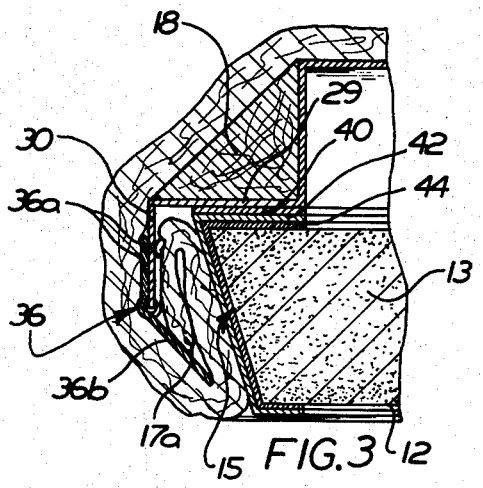
FIG. 3 is an enlarged section of the left side portion of FIG. 2 illustrating a snap-on insulation retaining clip.
Figure 4:
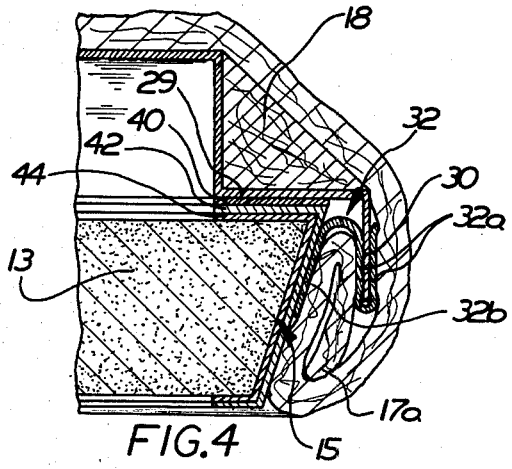
FIG. 4 is an enlarged section of the right side portion of FIG. 2, illustrating a snap-on matrix retaining clip.

With particular reference to FIGS. 3 and 4, there is illustrated means for retaining both the matrix 13 and the forward edge 17 of the insulation blanket 16 in position. It can be seen that the sidewalls 28 (FIG. 2) are stepped to provide a shelf or ledge portion 29 extending generally parallel to the back wall 26 (FIG. 2) of the sheet metal box 24.

The matrix 13 is sealed at its peripheral edge 15 by a first layer 44 of a refractory sealing and penetrating silica compound, such as Ludox HS-40, manufactured by E. I. DuPont de Nemours & Co., Inc., of Wilmington, De., U.S.A. Ludox HS-40 is an aqueous, colloidal silica dispersion of discrete particles of surface hydroxylated silica that is alkali-stabilized. The silica slightly penetrates the edge portions of the matrix to establish a gas-nonpermeable barrier. Over the first layer 44, a second layer 42 is applied, which constitutes a mixture of equal parts of alumina silicate refractory cement, such as White Line Cement manufactured by Fireline, Inc., of Youngstown, Ohio, U.S.A., and a colloidal silica such as the earlier-noted Ludox HS-40. White Line Cement is an alumina silicate mixed with about fifty percent colloidal silica. The White Line Cement-Ludox mixture serves to stiffen the matrix edge to maintain the integrity of the first layer 44. The layers 42, 44 are applied to the peripheral edge 15 of the matrix 13 and allowed to dry prior to assembly of the matrix 13 to the inner shelf portion 20 of the sheet metal box 24. To hold the matrix 13 in place, a layer 40 of adhesive-type cement is utilized. Cement for such purpose may be a rubbery, high-temperature resistant silicon cement, such as a clear silicon sealer, Catalogue No. 732-C1 111, manufactured by Dow-Corning, Inc., of Midland, Mich., U.S.A. The above-discussed method of sealing the peripheral edges of the matrix 13 and the adhesion of it to the shelf portion 29 is disclosed in U.S. Pat. No. 4,255,123, (Pearne, Gordon, Sessions, McCoy and Granger), assigned to the assignee of the present invention, the entirety of which is herein incorporated by reference.

As seen in FIGS. 3 and 4, the edge of the matrix 13 is beveled inwardly. Extending from the outer edge of the shelf portion 29, and perpendicular thereto, is the flange-like edge portion 30 of the sheet metal box 24. The flange 30 is of a length approximately equal to half the thickness of the matrix 13, which typically is of one to two inches in thickness. The flangelike edge 30 is equidistantly spaced from the peripheral edge 15 of the matrix 13, wherein a continuous inwardly tapered channel of generally constant width is established about the front face 12 of the burner.

In manufacturing the burner of the present invention, the sheet metal box 24 with the shelf portions 29 and the flangelike edge portion 30 is provided. A matrix heating element 13, with its edges sealed by layers 42, 44, is cemented in place by layer 40 onto the shelf 29. Four triangle-shaped insulation blocks 18 formed, for example, of the same type of material constituting the matrix 13, are cemented in place about the back side of the burner, as illustrated in FIG. 2.

With particular reference to FIG. 4, a plurality of matrix-retaining, spring steel clips 32, having a pair of leg portions 32*a*, are snapped onto the flange 30 at spaced intervals about the matrix 13. The clips 32 include a fingerlike projection 32*b*, which engages the beveled edge 15 of the matrix 13 and is compressed toward the flange 30 to apply a biasing force maintaining the matrix 13 in position. With the clips 32 in position and the blocks 18 cemented in place, an insulation blanket of, for example, one-eighth inch flexible Kaowool, is draped over the back of the burner 10, with the forward edge portion 17 of the blanket 16 being doubled over and stuffed or press-fitted between the matrix edge 15 and the flangelike edge 30 of the box 24. It is noted that the blanket can be either one piece with appropriate folds or a plurality of form-fitted pieces that are fastened together using conventional fastening means, such as clips, adhesives, or the like.

With reference to FIG. 3, a second plurality of clips 36 utilized to retain the insulation edge portion 17 in the channel between the flange 30 and the beveled edge 15 of the matrix 13 are provided. The clips 36 also include a pair of leg portions 36*a* that snap onto the flangelike edge 30 in a manner similar to the clips 32 discussed earlier. The clips 36*a* are spaced at intervals about the matrix 13 and preferably alternate with the matrix-retaining clips 32. The clips 36 include a fingerlike projection 36*b* that extends from the flangelike edge 30 partially into the channel between such edge 30 and the peripheral edge 15 of the matrix. There is enough space left between the end of the fingerlike projection 36*b* and the peripheral edge 15 to permit the doubled up edge of the insulation material to be forced between it. The end 17*a* of the edge portion 17 of the insulation blanket 16 is tucked behind the fingerlike projection 36*b* and maintained in position between such projection 36*b*, the shelf 29 supporting the matrix 13. The fingerlike projection 36*b* is resilient, and tends to bias the blanket portion 17 (see FIG. 2) against the edge 15 of the matrix to preclude the entry of high-temperature gas by-products generated by burning at the face 12 into the channel between the flangelike edge 30 and the matrix edge 15.

It has been found that a construction as illustrated and discussed above in accordance with the present invention, while eliminating the complexity of a separate air cooling system for the burner, provides adequate insulation protection for the sheet metal box 24 and the edge 15 of the matrix 13 such that thermal expansion and contraction of such elements are limited to an acceptable level. The burner of the present construction is very inexpensive to manufacture and has been found to be reliable and easily maintainable. Further, the blanket edge portion 17 covers both the clips 32, 36 and the metal edge portion 30 to shield them from combusted gas by-products. Further, in cycling the burner on and off, the insulation blanket seems to retard the rate of heating and cooling of the sheet metal box plenum, thus further lessening the possibility of burner failure that would be likely with more rapid rates of thermal expansion and contraction.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A gas-fired radiant burner comprising:

a gas-permeable matrix of refractory fiber material having a generally equal degree of porosity throughout, the matrix having an inner face, an outer face, and a gas non-permeable peripheral edge separating the faces;

a plenum means sealed against the periphery of the inner face of the matrix to supply a pressurized combustible gas thereto for burning at the outer face of the gas-permeable porous matrix;

a flexible blanket of thermal insulation material wrapped around the outside of the plenum means to thermally insulate the plenum means from high temperature gas by-products generated by said burning, an edge portion of the blanket being biased against the edge of the matrix; and a plurality of clip means positioned at spaced intervals about the matrix edge and engaging the edge portion of the blanket to maintain it in its biased position against the matrix edge, the clips being supported solely by the plenum means.

2. A radiant burner according to claim 1, wherein the blanket of insulation material covers all exposed outer surfaces of the plenum means.

3. A radiant burner according to claim 1, wherein the blanket of insulation material covers the clips to thermally insulate the clips from high temperature gas by-products gnerated by said burning.

4. A gas-fired radiant burner comprising:

a gas-permeable matrix of refractory fiber material having a generally equal degree of porosity throughout, the matrix having an inner face, an outer face, and a gas non-permeable peripheral edge separating the faces, the matrix being board-like and of a flat rectangular geometry;

an open-ended sheet metal box having four sidewalls and a back wall, the sidewalls being stepped to provide a shelf portion parallel to the back wall and inwardly spaced from the open end of the box, the periphery of the inner face of the matrix being adhesively sealed to the shelf portion wherein the matrix completely closes the open end of the box, the interior volume of the box being supplied and pressurized with a combustible gas forced through the porous matrix for burning at its outer face, the gas non-permeable peripheral edge of the matrix being adjacent to and spaced from a forward sidewall edge of the box perpendicular to the back wall, the edge of the matrix and the forward edge of the sheet metal box defining a circumferentially extending, inwardly tapered channel of generally constant width about the outer face of the matrix;

a flexible blanket of fibrous thermal insulation material wrapped around and in contact with all exposed outside surfaces of the sheet metal box to thermally insulate the sheet metal box from high temperature gas by-products generated by said burning, an edge portion of the blanket being press-fitted into the channel to thermally insulate the forward edge of the box from said gas by-products; and a plurality of metal clips snapped onto and supported by the forward edge of the box, the clips being covered by the insulation blanket and maintaining the insulation blanket edge portion in place in said channel.

5. A radiant burner according to claim 4, wherein each of said clips includes a finger portion extending from the forward edge of the box partially into the channel, the finger portion being spaced from the shelf portion, the edge portion being positioned between the shelf portion and the finger portion to retain it in the channel, the finger portion being resilient to bias the edge portion of the blanket against the peripheral edge of the matrix.

6. A radiant burner according to claim 5, including another plurality of metal clips spaced at intervals about the periphery of the matrix and snapped onto and supported by said forward edge, said another plurality of clips engaging the periphery of the matrix and biased against it to maintain the position of the matrix on the shelf, said another plurality of clips being covered by the insulation blanket to thermally insulate them from said gas by-products.

7. A radiant burner according to claims 5 or 6, wherein said edge portion of the insulation blanket generally fills the channel to preclude the entry of said gas by-products into the channel.

* * * * *